United States Patent [19]

Beretta

[11] Patent Number: 4,479,418

[45] Date of Patent: Oct. 30, 1984

[54] MEANS FOR ATTACHING SILENCERS TO PORTABLE FIREARMS

[76] Inventor: Pier C. Beretta, Via P. Beretta 10, Gardone V.T. (Brescia), Italy

[21] Appl. No.: 416,584

[22] Filed: Sep. 10, 1982

[30] Foreign Application Priority Data

Sep. 30, 1981 [IT] Italy ..... 5214 A/81

[51] Int. Cl.[3] ..... F41C 21/18

[52] U.S. Cl. ..... 89/14 D

[58] Field of Search ..... 89/14 R, 14 C, 14 D, 89/14 E

[56] References Cited

U.S. PATENT DOCUMENTS 2,805,602 9/1957 Moore ..... 89/14 E

FOREIGN PATENT DOCUMENTS 437724 11/1926 Fed. Rep. of Germany ..... 89/14 E

*Primary Examiner*—Stephen C. Bentley

*Attorney, Agent, or Firm*—McGlew and Tuttle

[57] ABSTRACT

A device is described for attaching a silencer to a portable firearm, such as a pistol, which is characterized by a combination of elements such as a silencer-supporting body which has an axial aperture for receiving the barrel of the firearm, and a pair of arms one on each side of the barrel extending parallel to the body of the firearm toward the trigger guard thereof. There are two spines in the device one parallel to the axial opening of the body of the silencer and the other transversely located thereto and serving as a blocking mechanism. The second spine serves the purpose of preventing the automatic operation of the firearm and is so constructed so as to prevent its complete detachment from the device itself. An arresting spring engages alternatively a pair of throats provided on a terminal head of one of the arms so as to block the spine in one of two corresponding positions. The silencer may be provided with its aiming mechanism which can be used in place of the existing one on the firearm. A small piston lodged transversely in the body of the silencer constitutes the activating and deactiving means of a lever which controls the blocking of the automatic operation of the firearm.

8 Claims, 3 Drawing Figures

MEANS FOR ATTACHING SILENCERS TO PORTABLE FIREARMS

FIELD OF THE INVENTION

The present invention relates to means for attaching silencers to portable firearms and, particularly, to means for attaching a silencer to pistols of all types.

BACKGROUND OF THE INVENTION

Presently, according to the most widely employed arrangements, the silencers for portable firearms are applied thereto by means of a threading action or by means of a bayonet-type coupling. In both cases, however, the application of the silencer to the firearm requires always a rotational movement of the silencer, either complete or partial and this renders the operation somewhat cumbersome and slow in execution. Furthermore, such an operation may give rise to problems with respect to the aiming or leveling sight of the firearm, especially in the case of silencers which are attached by means of threading.

SUMMARY OF THE INVENTION

It is one object of the present invention to provide a means for attaching a silencer to a portable firearm, which allows a simple, uncomplicated and rapid application of the silencer to a firearm by simple coupling thereof in the axial direction, without any rotational movement of the silencer, such coupling being possible with rapidity and precision even under conditions of poor visibility.

It is another object of the present invention to provide a means for attaching a silencer to a portable firearm, which permits the attachment of the silencer directly to the body of the firearm and without any fastening to the barrel thereof. In this way it is possible to leave unaltered the moving parts of the firearm and to avoid any influence on the correct dynamics of the firearm. This is particularly advantageous and of basic importance in the types of pistol which have a geometric closing and which have a barrel with short recoil.

It is a further object of the present invention to provide a means of attaching a silencer to a portable firearm, which silencer is further provided with blocking means for preventing the automatic operation of the firearm when the silencer is mounted thereon. Such an arrangement has the two-fold advantage of eliminating all noises originating from the mechanical elements of the firearm subjected to recoil and of eliminating the exiting of the residual gases from the firing chamber during the phase of opening of the firearm. These blocking means are associated directly to the means of attachment of the silencer and have the further advantage of being removable from the firearm concurrently with the disassembling of the silencer from the firearm, without leaving any possibility of influencing the normal operation of the firearm when the silencer is detached therefrom, which is not the case if such blocking means were mounted instead on the body of the firearm.

It is still a further object of the present invention to provide a means for attaching a silencer to a portable firearm, which without rotation thereof is capable of retaining always the correct positioning of the aiming mechanism and elements attached on the silencer, when the latter is mounted on the firearm. It is thus possible to provide the silencer with aiming means that are calibrated aforehand and are employable without further correction in substitution of those normally existing on the firearm.

The above mentioned objects of the present invention may be obtained by means of the device described more fully hereinbelow, the object of which is to attach the silencer to a portable firearm, such as a pistol, having among other elements a body, a barrel mounted on such body and associated with a firing mechanism and a trigger guard fixedly attached to the body for the protection of the trigger. The means for attaching the silencer to the portable firearm comprises a body for carrying the silencer and having an axial aperture for accepting the forward extremity of the barrel of the pistol; a pair of arms integral with the body and extending parallel to the body of firearm toward the trigger guard; a first spine fixedly attached to the body of the silencer and parallel to the axial aperture, that is to the barrel of the firearm and resting within an opening provided in the forward extremity of the body of the firearm; and a second blocking spine engaging transversely the arms of the silencer to the trigger guard, such second spine being positioned perpendicularly to the axis of the first mentioned spine so as to become associated with and engage blocking means actuated by a spring or snap-wise.

BRIEF DESCRIPTION OF THE DRAWINGS

Greater details of the invention will become apparent from the following description thereof and from the accompanying drawings, which are merely illustrative and not limitative of the invention, in which.

DESCRIPTION OF THE PREFERRED EMBODIMENT

Figures 1, 2, 3:
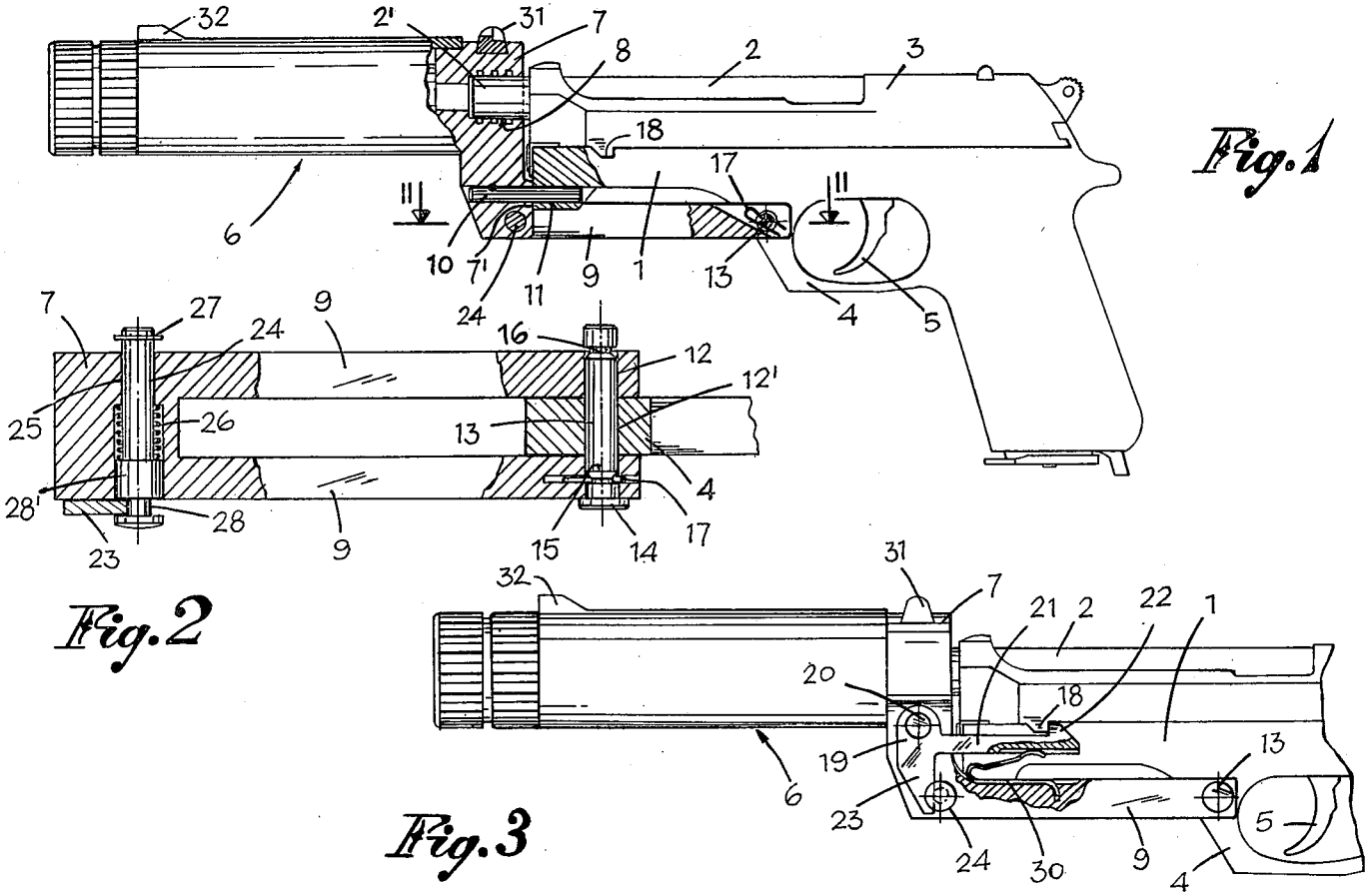
FIG. 1 is a lateral view of a pistol with a sectional partial view of means for attaching the silencer thereto.
FIG. 2 is a longitudinal sectional view taken along arrows II—II of FIG. 1.
FIG. 3 is a lateral and partially sectional view of the blocking means of the firing mechanism which prevent the automatic operation of the firearm when the silencer is attached thereto.

With reference to the accompanying drawings, the body or frame of a pistol is indicated at 1, see FIG. 1, on which are mounted in a manner well known per se a barrel 2 which may be fixed or movable, depending on the type of pistol employed, and a firing mechanism 3. Beneath the body of the pistol 1 there is fixedly attached the trigger guard 4 for the protection of the trigger 5 against accidental collisions.

To the body 1 of the pistol there is attachable a silencer, generally indicated at 6, which has internally thereof known appropriate characteristics which are not illustrated in the accompanying drawings and which do not form part of the invention per se and which are well known in the art. The silencer 6, when mounted on the pistol, is coaxially positioned with respect to the barrel 2.

The attachment of the silencer 6 is obtained, in accordance with the present invention, through a means for attaching the silencer that comprises a body 7 for supporting the silencer and having an axial aperture 8 for receiving, without fastening means, the forward extremity 2' of the barrel 2. The body 7 possesses, integrally therewith, two arms 9 parallel to each other and extending parallel to the body 1 of the pistol, on the underneath thereof and toward the trigger guard 4. The extremities of the two arms thus result on opposite sides of the trigger guard itself, see FIG. 2.

To the body 7 is also attached, see FIG. 1, a first spine 10 the axis of which is parallel to the axis of the aperture 8, that is to the axis of the barrel 2. This spine 10 protrudes from the body 7 toward the body 1 of the pistol and can be seated by simple sliding therein in a corresponding opening 11 provided in the forward extremity of the body of the pistol. This first spine serves the function of achieving a correct and constant alignment of the means for attaching the silencer on and with respect to the firearm.

On the extremities of the arms 9 and in correspondence with the trigger guard 4 there are provided openings 12, 12' having an axis oriented in the direction perpendicular with respect to the axis of the first mentioned spine 10. These openings 12—12' serve to receive a second and transverse spine 13 for blocking the means of attachment of the silencer to the firearm.

In this manner, to mount the silencer 6 on the firearm it is sufficient to lodge, by simple displacement in the axial direction, the extremity 2' of the barrel 2 within the aperture 8 of the body 7 and the first spine 10 within the head opening 11 of the body 1. As a result of such a coupling, the body 7 comes to rest at 7' against the head of the body 1 of the firearm, insuring therefor the coincidence of the opening 12 of the arms 9 with the opening 12' within the trigger guard 4, so that it becomes possible to lodge the second spine 13 within such openings and to prevent the detachment of the silencer from the firearm.

To detach or dismount the silencer, it is sufficient to remove first the transverse spine 13 and to displace then the silencer 6 forwardly until the first spine 10 is completely slid off the opening 11.

It is to be noted, however, that the transverse spine 13 offers preferably an arresting head 14 against an arm 9 and two circular throats 15–16 provided in the proximity of the head 14 and, respectively, of the opposed extremity of the spine. On arm 9, against which rests the head 14 of spine 13, there is mounted an arresting spring 17, see FIGS. 1 and 2, which serves to engage one or the other of the two circular throats 15, 16.

When the transverse spine 13 is lodged in the openings 12, 12' in condition of attachment of the silencer to the weapon, the arresting spring 17 engages the throat 15 and thus prevents the accidental sliding of the spine itself. When, on the other hand, the spine is slid from the openings 12, 12' for the disassembling of the silencer, the arresting spring 17 engages the other circular throat 16 so as to prevent the complete sliding of the spine 13, with the result that the same is on one hand always engaged to the corresponding opening and, on the other hand is prevented to completely separate itself from the silencer and possibly becoming lost.

In accordance with another feature of the invention, on one side of the firing mechanism 3 of the firearm there is provided a tooth 18, while on the same side of the body 7 of the silencer there is mounted an arresting lever 19 which serves to cooperate with tooth 18 so as to block the carriage of the firing mechanism 3 and to prevent the automatic operation of the firearm when the silencer is mounted thereon.

Particularly, the arresting lever 19, which is of the pivoting type, is pivoted on the body 7 by means of a pivot or pin 20 and comprises a first arm 21 having a terminal nose 22 facing toward and cooperating with the tooth 18 and a second arm 23 facing downwardly. The first arm 21 is actuated by a spring 30 which tends to keep it displaced upwardly, that is toward the tooth 18. To the second arm 23 there is associated a small piston 24 which allows the activation and deactivation of the lever 19. Such piston 24 is guided within a transverse seat 25 provided in the body 7 and is actuated by a spring 26 which tends to keep it displaced constantly toward the outside of the seat on the side of the second arm 23 of the arresting lever 19. Such a displacement is limited by an axial arresting collar 27. The piston 24 has furthermore a throat 28 in which is adjusted the arm 23 of the lever 19, when the latter must act with its terminal nose 22 on the tooth 18 of the carriage of the firing mechanism 3.

Such a condition is illustrated in FIGS. 2 and 3 of the accompanying drawings and permits to block the carriage of the firing mechanism 3 through the action of the nose 22 of the arm 21 of the lever 19 on the tooth 18.

To cancel or void, when necessary, such a blocking action it is sufficient to displace the lever 19 in opposition to the action of the spring 30; as a result, the second arm 23 becomes detached from the throat 25 of the small piston 24, which, urged by the respective spring 26, moves toward the outside of the seat with its part 28' alongside the throat 25, so as to block the lever 19 and prevent that the nose 22 engages the tooth 18.

Finally, it is to be observed that on the body 7 of the means for attaching the silencer to the firearm there are provided noses 31, 32 which constitute the aiming element to be utilized in place of those already available on the firearm. These sighting devices may be employed due to the exact and perfect mounting and alignment of the silencer on the firearm so that it becomes unnecessary to rely on the weapon's devices itself.

I claim:

1. Means for attaching a silencer to a portable firearm having a firearm body, a barrel mounted on said firearm body, a firing mechanism associated with said barrel and a trigger guard, said means comprising a mounting body for supporting said silencer and having an axial aperture therein for accepting the forward extremity of said barrel; a pair of arms integral with said mounting body and positioned one on each side thereof and extending parallel to said firearm body toward said trigger guard, the extremities of said arms resting on opposite sides of said trigger guard; a first spine fixedly attached to said mounting body and parallel to said axial aperture and lodging within an opening provided in a forward extremity of said firearm body; a second blocking spine for engaging transversely said arms to said trigger guard, said second spine being positioned perpendicularly to the axis of said first spine and being engaged by spring-type arresting means.

2. Means according to claim 1, wherein said arms and said trigger guard are provided with transverse openings for lodging said second blocking spine, said second blocking spine having a terminal arresting head against one of said arms and a pair of circular throats provided in the proximity of said head and, respectively in the proximity of the opposed extremity of said spine, the arm against which rests said head having mounted thereon an arresting spring which alternately engages one or the other of said pair of throats so as to arrest said spine in either of the corresponding positions.

3. Means according to claim 1, wherein on one side of said firing mechanism there is provided a tooth and wherein on a same side of said mounting body there is pivotably attached a lever, said lever having a first arm with a terminal nose for engaging said tooth for blocking said firing mechanism, and a second arm facing toward and cooperating with a means for activating and deactivating said lever, said lever being furthermore urged by a spring which tends to displace said first arm toward said tooth and said second arm toward said activating and deactivating means.

4. Means according to claim 3, wherein said means for activating and deactivating said lever comprises a spring loaded piston transversely lodged within said body and having a circular throat for receiving said second arm of said lever when said lever is in blocking position, said throat having on one side thereof a portion with greater diameter so as to arrest said lever in a condition of detachment from said firing mechanism.

5. Means according to claim 1, in which on said mounting body there are mounted a pair of noses forming aiming device of said silencer.

6. A mount for mounting a silencer to a handgun having a frame with a trigger guard, a barrel and a firing mechanism associated with the barrel, comprising:

a body for supporting a silencer, the body having an axial aperture therein for accepting a forward portion of the barrel;

a pair of arms connected to said body and extending parallel to and under said frame, said pair of arms extending to the trigger guard and over opposite sides of the trigger guard, the trigger guard having an opening therethrough transverse to an axis of the barrel and said pair of arms each having an opening therethrough alignable with the opening of the trigger guard;

a spine extending through said openings of said arms and the opening of the trigger guard for fixing said body to the trigger guard; and spring-type arresting means associated with said spine for holding said spine in a position engaging said arms to the trigger guard.

7. A mount according to claim 6, wherein the firing mechanism includes a movable portion movable with respect to the handgun frame for automatically loading the handgun, a movable portion having a tooth, a lever pivotally mounted to said body having a first lever arm engageable with the tooth for holding the movable portion in a fixed position, said lever having a second lever arm, a first spring connected to said body and engaged with said first lever arm for biasing said first lever arm into engagement with the tooth, said body defining a seat, a piston slidably mounted in said seat, said piston having a throat for engaging said second lever arm with said first lever arm in engagement with the tooth, said piston including a large diameter portion adjacent said throat, and a second spring engaged to said piston and disposed in said seat for biasing said piston into a position to move said large diameter portion into engagement with said second lever arm, said first lever arm being out of engagement with the tooth when said second lever arm is in engagement with said large diameter portion.

8. A mount according to claim 6, including a further spine connected to said body and extending parallel to the barrel, the frame having an opening extending parallel to the barrel for receiving said further spine to align said body with respect to the frame.

* * * * *